United States Patent [19]

McLean

[11] Patent Number: 4,733,501

[45] Date of Patent: Mar. 29, 1988

[54] HONING GUIDE

[75] Inventor: Francis A. McLean, Ontario, Canada

[73] Assignee: Lee Valley Tools Ltd., Ottawa, Canada

[21] Appl. No.: 910,468

[22] Filed: Sep. 23, 1986

Related U.S. Application Data

[63] Continuation-in-part of Ser. No. 778,625, Sep. 23, 1985, abandoned.

[51] Int. Cl.[4] ..... B24B 3/36

[52] U.S. Cl. ..... 51/221 BS; 51/218 A

[58] Field of Search ..... 51/221 BS, 221 R, 220, 51/218 A, 218 R, 217 A, 216 A, 216 H, 218 P

[56] References Cited

U.S. PATENT DOCUMENTS

| | | | |
|---|---|---|---|
| 166,830 | 8/1875 | Weaver | 51/218 A |
| 210,957 | 12/1878 | Olsen | 51/221 |
| 364,353 | 6/1887 | Kampfe | 51/218 A |
| 449,673 | 4/1891 | Francis | 51/221 |
| 560,111 | 5/1896 | Salot | 51/221 R |
| 729,319 | 5/1903 | Fowler | 51/221 R |
| 1,239,494 | 9/1917 | Lange | 51/221 R |
| 1,770,538 | 7/1930 | Warner | 51/220 |
| 2,353,096 | 7/1944 | Weidaver | 51/218 R |

FOREIGN PATENT DOCUMENTS

| | | | |
|---|---|---|---|
| 526996 | 10/1930 | Fed. Rep. of Germany | 51/221 |
| 1205686 | 6/1958 | France . | |
| 215818 | 11/1923 | United Kingdom . | |
| 326370 | 4/1929 | United Kingdom . | |
| 626372 | 5/1947 | United Kingdom . | |
| 693863 | 7/1953 | United Kingdom | 51/221 R |
| 795157 | 5/1958 | United Kingdom | 51/218 R |
| 911900 | 9/1961 | United Kingdom . | |

*Primary Examiner*—Frederick R. Schmidt
*Assistant Examiner*—Robert A. Rose
*Attorney, Agent, or Firm*—Kilpatrick & Cody

[57] ABSTRACT

A honing guide is provided in which a tool support plate is mounted above a surface-engaging roller. The surface-engaging roller is mounted eccentrically so that the height of the tool support plate may be varied to provide a range of honing angles without unclamping the tool from the guide.

3 Claims, 13 Drawing Figures

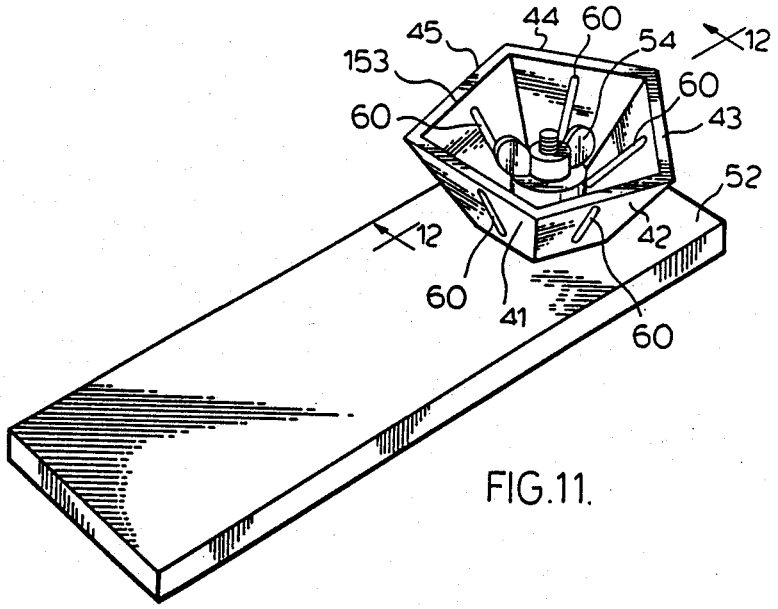
FIG.11.
FIG.12.
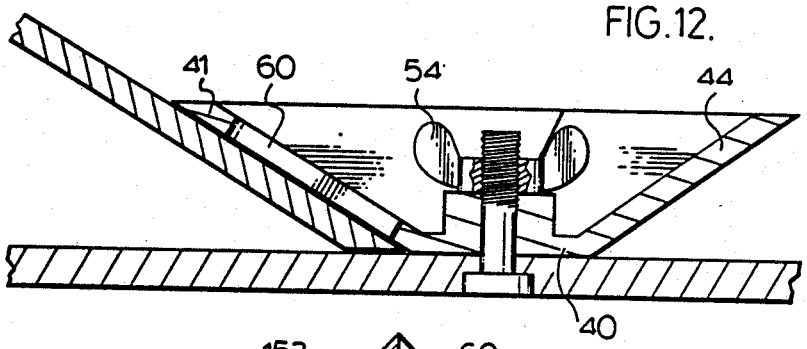
FIG.13.
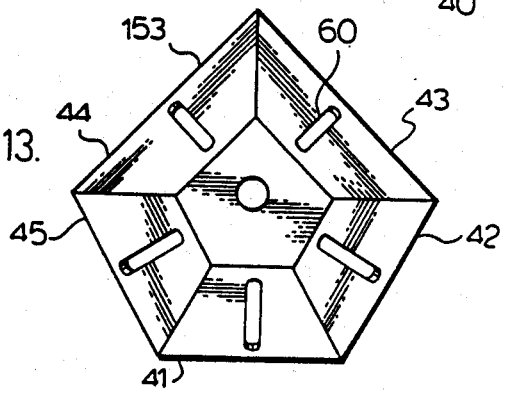

HONING GUIDE

This application is a continuation-in-part of U.S. application Ser. No. 778,625, filed Sept. 23, 1985 now abandoned.

FIELD OF THE INVENTION

The present invention relates to honing guides or alternatively, tool grinding rests.

BACKGROUND OF THE INVENTION

In normal cutting tool sharpening it was common to use jigs to hold the tool to be sharpened at a predetermined angle to a large water-cooled grind stone. These grinding jigs usually comprised a roller which supported a plate upon which the tool was secured and by which the tool was held at a selected angle against the stone surface. Both the roller and tool were held against the grind stone and as the stone was moved the cutting edge was ground to the selected angle.

It will be evident that the successful use of such jigs were predicated upon the human skill of the artisan. Examples of such jigs are illustrated in Marples Catalogue of Tools, published 1909, #7314; Millers Falls Company Catalogue 1915, p. 159, #569; Dictionary of Tools, R. A. Salaman, Scribners Inc., 1975, p. 215, 216, and as will be evident the initial setting of the tool in the jig is critical to the success of the operation.

The present use of such guides is now customarily limited to flat bench stones since power stones are not large enough in diameter and knowledge of their use has in major part been lost.

The skilled artisan differentiates between grinding and honing with "grinding" being considered as defining the basic edge and "honing" as refining the basic edge to the finished sharp edge.

In the normal sharpening process the edge to be sharpened is initially passed over the coarse stone at a selected angle, the "bevel angle". This process leaves a ragged edge of the desired angle. The bevel is then refined over a stone of finer particles and since such stones cut more slowly the work is done on that part of the bevel which intersects with the face of the tool to provide a micro-bevel.

Usually, a tool with a bevel of 25° will have a micro-bevel of 5° making a total angle of 30°. The micro-bevel selected should be a function of the tool material, the material to be cut and the intended use. Ideally the bevel angle should be no greater than is necessary to prevent the edge from breaking down so that the wedging action of the tool is minimized as the edge enters the material to be cut.

At present the micro-bevel angle differs from the basic bevel angle by about 5°, i.e. when the basic bevel angle is 25° the micro-bevel is 30°. As mentioned previously, smaller differences are preferred but they are not feasible because it has not been possible to set both bevels and micro-bevels consistently. Furthermore, it has not been possible to set lesser micro-bevels with any consistency.

SUMMARY OF THE INVENTION

To overcome the difficulties extant with the prior art jigs and to provide a tool which can be operated with facility, consistency and accuracy, there is provided a honing guide which has a plate upon which the tool to be sharpened may be secured. This plate is supported by a roller mounted thereunder. The roller is in turn supported eccentrically on a shaft and the shaft is provided with indents so that it may matingly engage a lock so that the angle of the bevel may be changed to provide a micro-bevel.

These variations are accomplished by providing preselected variations in the angle of the setting by varying the height of the axis of the roller relative to the grinding surface.

BRIEF DESCRIPTION OF THE DRAWINGS

These and other features of the subject invention will be better understood from the detailed description in which a preferred embodiment is described and in which:

FIG. 11 is a perspective view of an alternative embodiment of an angle guide;

FIG. 12 is a section taken along line 12—12 of FIG. 11; and

FIG. 13 is a plan view of the angle block illustrated in FIG. 11.

DETAILED DESCRIPTION

Figure 1:
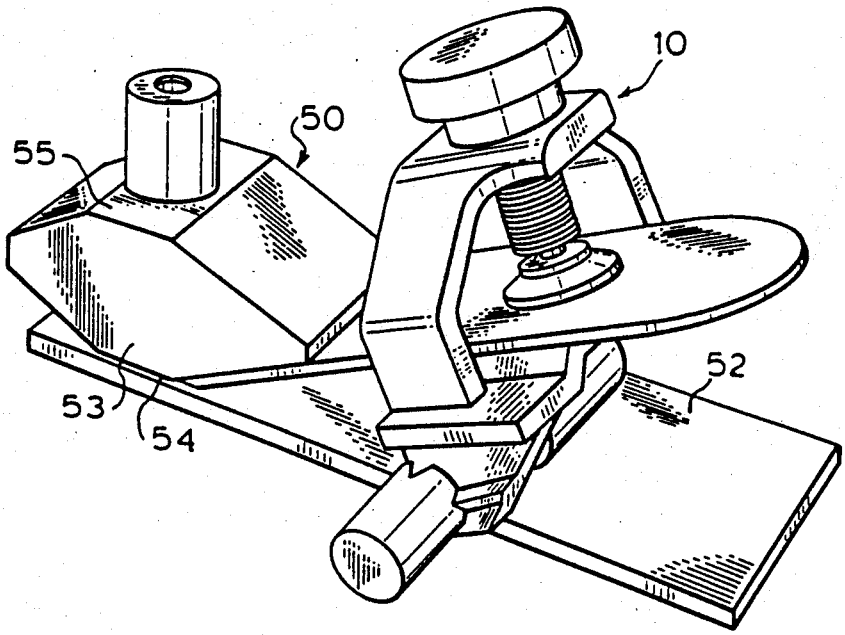
FIG. 1 is a general three-quarter perspective view from the rear and top of a honing guide in accordance with the present invention.
Figure 2:
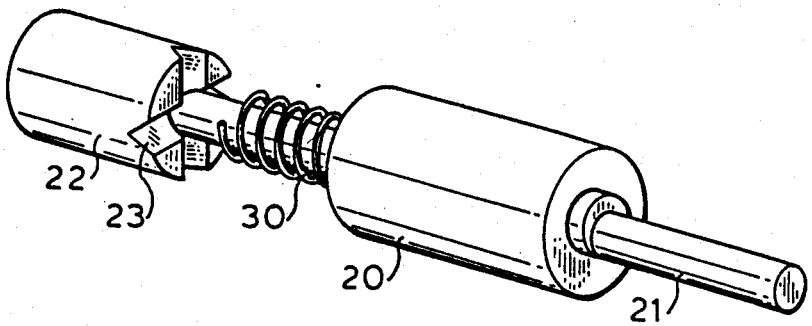
FIG. 2 is an exploded perspective view of an adjustment mechanism for setting the attitude of a honing guide in accordance with the present invention.

In the embodiment illustrated in FIG. 1, a honing guide in accordance with the present invention is generally indicated at 10, as illustrated, it comprises a substantially U-shaped bracket, 12, with a transverse portion, 13, and depending legs 15 and 16, across which a tool support plate 14 extends as shown. Tool support plate 14 has a planar upper surface 17 upon which the tool to be sharpened, 18, rests and is secured by screw 19. Below tool support 14 a roller 20 is mounted on shaft 21 and this shaft is in turn rotatably mounted on legs 15 and 16.

Roller 20 is eccentrically mounted on shaft 21. On one end of shaft 21, a handle 22 with circumferentially spaced detents such as 23, 24, 25 and 26, is provided. Between roller 20 and leg 15 a spring 30 is mounted to normally bias the handle and its detents such as 23, 24, 25 and 26 into engagement with a projection 31 on the outer wall of leg 15.

In FIG. 1 the honing guide is illustrated as being used in conjunction with an angle guide generally indicated at 50. The angle guide comprises a plate 52 to which an angle block 53 is secured by screw 54. The block 53 has eight surfaces two of which, 54 and 55, are parallel and planar and of the remaining surfaces four define the angles indicated with the upper surface of plate 52 when appropriately mounted thereon.

Figure 3:
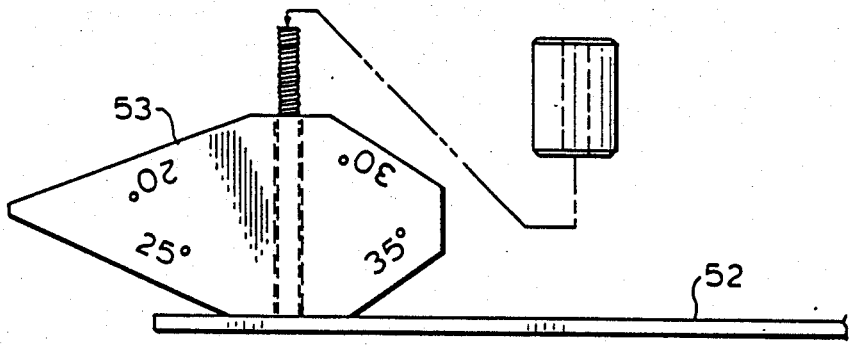
FIG. 3 is a side elevation of a bevel guide used in association with the present invention.
Figure 4:
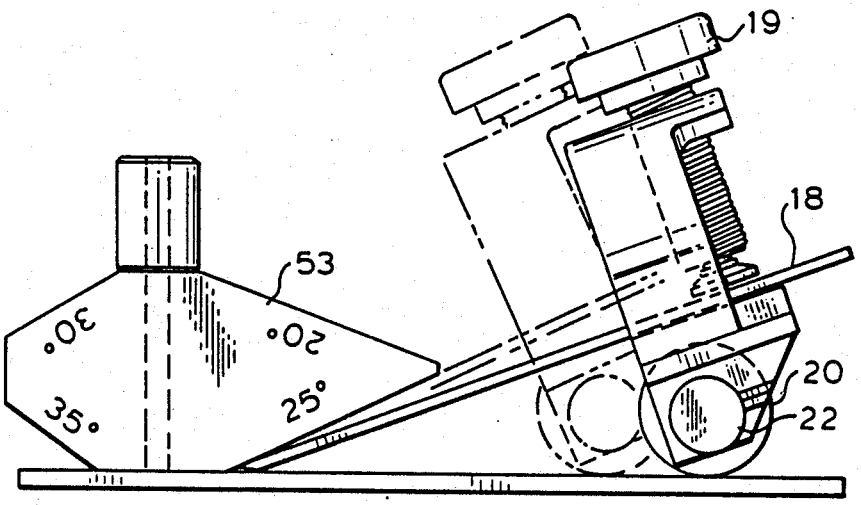
FIG. 4 is a side elevation showing a bevel guide and a honing guide in accordance with the present invention in solid and broken lines which serves to illustrate the use and function of the present invention.
Figure 5:
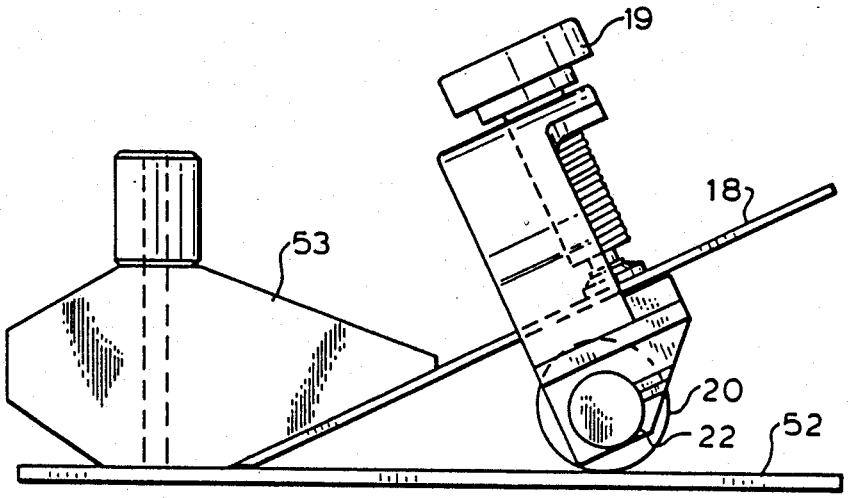
FIG. 5 is a side elevation of the bevel guide and honing guide of the present invention in a finally adjusted attitude.

As shown in FIGS. 3 to 5, the tool user mounts the angle block 52 on the plate 53 at the required cutting edge angle.

In FIG. 3 the angle is at 35° and in FIG. 4 the block 53 has been turned so that the angle defined is 25°. The block is then secured by bolt 54.

The honing guide 10 is then placed on the plate with roller 20 in engagement with plate 52.

If as shown in FIG. 4 there is a difference between the angle defined by the block 53 and the angle of the cutting tool 18, screw 19 is released and the honing guide 10 is moved as shown in dotted outline until the attitude of the tool 18 and the angle of the block 53 coincide as in FIG. 5. In this position screw 19 is then turned down and the tool 18 is secured.

After the foregoing setting, the tool may then be sharpened on a flat stone until the necessary edge has been achieved. As mentioned previously, this edge will generally not be acceptable to the highly skilled craftsman and such an artisan will demand a micro-bevel created on a stone with finer grit such as further enhances the cutting capacity of the tool.

To achieve this further capacity with the present honing guide the craftsman pulls handle 22 laterally so that the engagement between the projection and detent is released; turns handle 22 to the required new attitude and engages the appropriate detent with the projection 31. This operation is illustrated in FIGS. 6 through 10.

Figure 6:
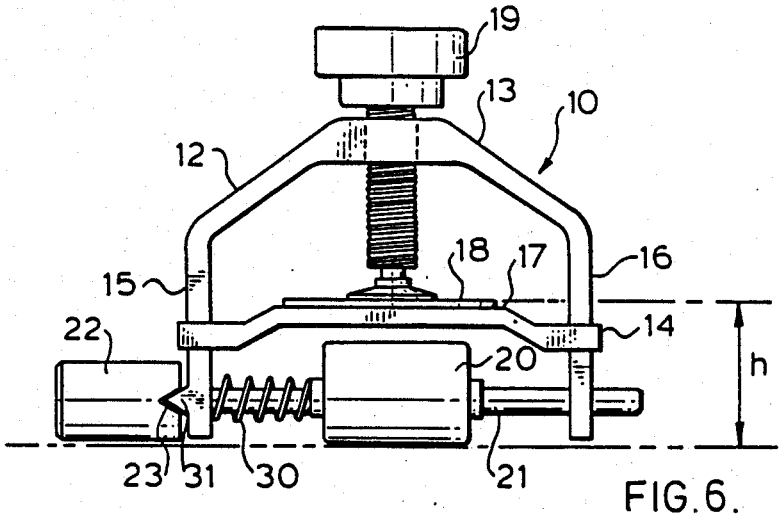
FIG. 6 is a diagrammatic end elevation of a honing guide in accordance with the present invention.
Figure 7:
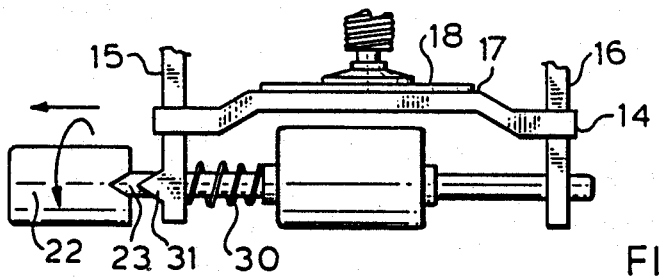
FIG. 7 is a diagrammatic end elevation of the lower part of a honing guide in accordance with the present invention and serves to illustrate the varying operation of the cutting tool attitude adjustment mechanism in accordance with the present invention.
Figure 8:
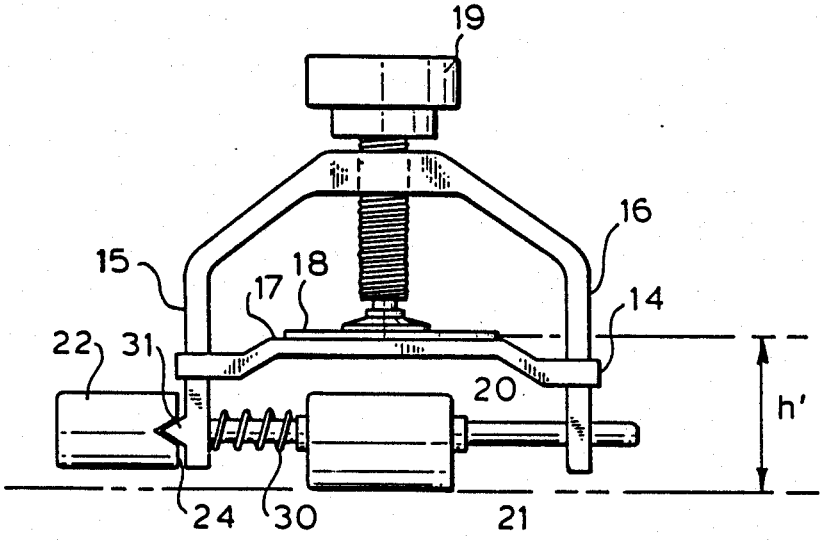
FIG. 8 is a further diagrammatic end elevation of a honing guide in accordance with the present invention which has been adjusted to a further angle or attitude from that illustrated in FIG. 6.

As shown in FIG. 6, detent 23 on handle 22 is engaged with projection 21. Handle 22 is pulled laterally against spring 30 until the detent 23 and projection 31 are disengaged. Handle 22 is then rotated in the direction indicated by the arrow and the next detent 24 engaged with projection 31. The action of the spring 30 will, of course, lock the projection 31 and detent 24 in engagement.

Figures 9, 10:
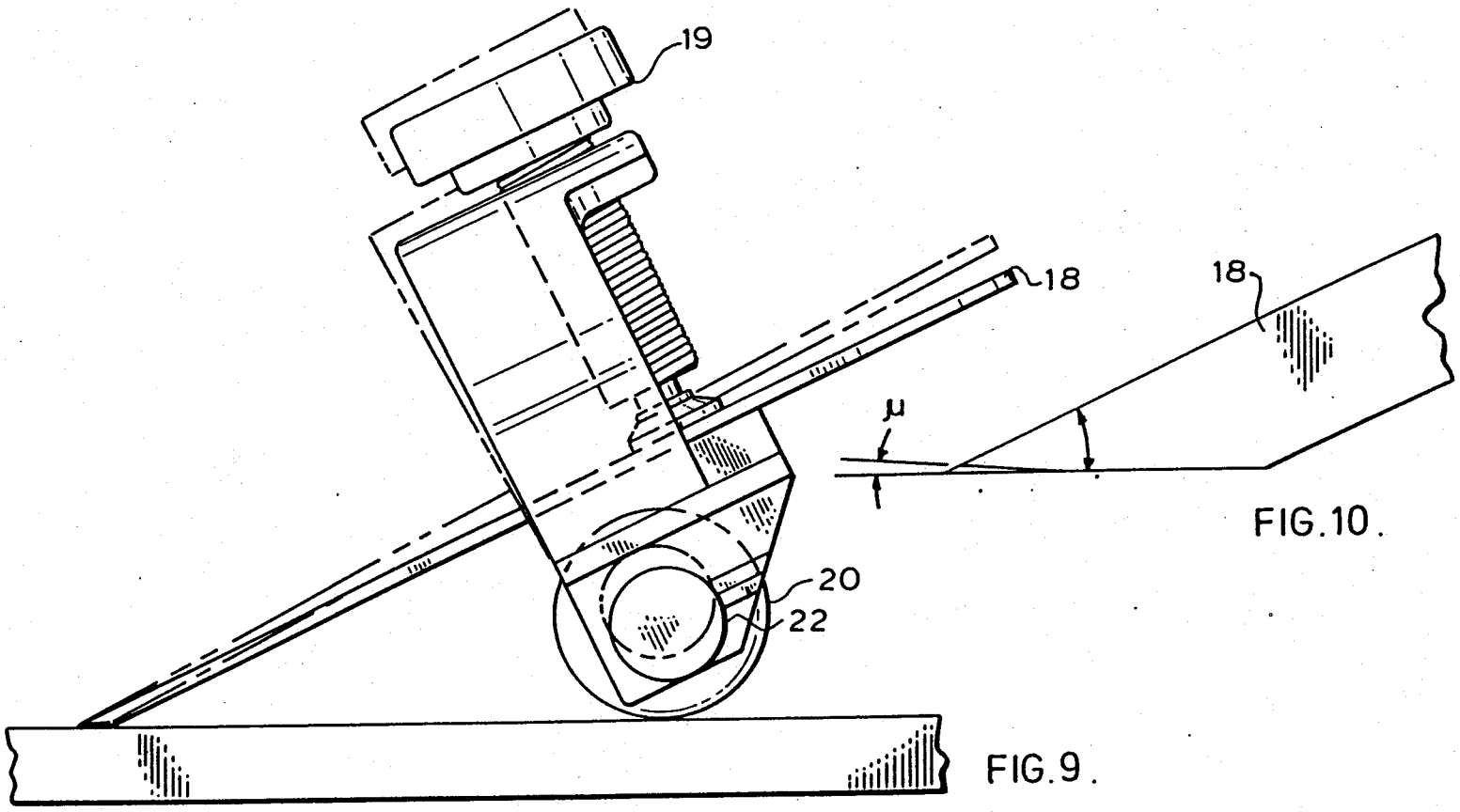
FIG. 9 is a side elevation of a honing guide in accordance with the guide being shown in solid outline in a first position and dotted outline in a second position so as to illustrate the variation in attitude to produce a micro-bevel.
FIG. 10 is an enlarged partial side elevation of a cutting edge showing the effect achieved by the adjustment of FIG. 9.

It will be noted that because of the eccentric mounting of roller 20 on shaft 31, the height from the bottom of roller 20 to the main plane of the cutting tool 18 is varied and in this example increased. As a consequence, the attitude of the cutting tool will be changed, as shown in FIG. 9, from the solid outline to the dotted outline and similarly the micro-bevel provided will be as illustrated at $\mu$ in FIG. 10.

In the embodiment illustrated in the foregoing figures with a cam offset by 0.050" the following angles were obtained with the respective principal angles:

| 20° | 25° | 30° | 35° |
|---|---|---|---|
| 18° | 22°35′ | 27°16′ | 32° |
| 19° | 23°48′ | 28°38′ | 33°31′ |
| 20° | 25° | 30° | 35° |

-continued

| 20° | 25° | 30° | 35° |
|---|---|---|---|
| 21° | 26°11′ | 31°20′ | 36°26′ |
| 22° | 27°20′ | 32°26′ | 37°48′ |

In the embodiment illustrated in FIGS. 11 through 13 the plate is again indicated at 52; the alternative embodiment of the angle block is indicated at 153 and the fastening nut is indicated at 54.

As with angle block 53 angle block 153 is releasably secured to plate 52 by securing and releasing nut 54 which engages the threaded rod.

Angle block 53 comprises a bottom wall 40 from which a plurality of walls 41, 42, 43, 44 and 45 extending upwardly at different preselected angles. And in each wall there is provided a slot such as at 60.

On angle block 153 each of walls 41, 42, 43, 44 and 45 defines a different angle with the horizontal and each adjacent wall differs in its inclination by no more than 10°.

Wall 41 defines a 35° angle;
Wall 42 a 25° angle;
Wall 43 a 15° angle;
Wall 44 a 20° angle; and
Wall 45 a 30° angle.

The difference of 10° is not an absolutely critical angle. In the present embodiments angles 15°, 20°, 25°, 30° and 35° were selected as the more popular angles and to accommodate these angles and provide an operable configuration which could be cast or moulded with facility the angles had to be so oriented.

It will be apparent that other wall angles may be selected so that the difference in inclination between walls may vary between very wide limits.

The angle guide shown in FIGS. 11 through 13 are used in a manner similar to that shown in FIGS. 1 through 10.

Once the operator has selected the bevel angle he sets up the angle guide loosening the screw 60 and turning the guide 153 until the selected angle is defined with the plate 52.

With the tool loosely fitted in the honing guide it is rolled up to the block until the face of the tool is flush with the block. In this present embodiment this can be determined by looking through the slot 60. The blade may then be sharpened on the stone and the secondary bevel added without unclamping as described previously.

If the operator wishes to sharpen at another angle then all the operator has to do is to loosen the screw 54, rotate the angle guide 53 to the appropriate angle and repeat the process.

From the foregoing it will be apparent that with the honing guide of the present invention the user may achieve consistency in the setting of the angle of cutting edge, and he can get a finer micro-bevel with greater consistency than with those structures of the prior art.

To these advantages there are further corollaries: when resharpening it is much easier to grind off the required amount on a coarse stone since the tool has been shortened less and because the tool has been shortened less it lasts longer for an equivalent number of sharpenings.

What is claimed:

1. A honing guide for carrying a tool having a cutting edge to be honed over a honing surface, said guide comprising:

a tool support plate;

a bracket having at least one depending leg extending over said tool supporting plate;

adjustable fastening means for securing a tool to said tool supporting plate; and roller means having an axis mounted on said bracket leg below said tool supporting plate to carry said tool at selected attitudes over said honing surface, wherein said roller means is mounted eccentrically on a shaft, said roller means having a plurality of predetermined orienting stations thereon, and shaft orienting means mounted on said bracket for engaging selected ones of said orienting stations to select a variation in attitude of said cutting edge.

2. A guide as claimed in claim 1 further including locking means to maintain said shaft orienting means in engagement with said selected orienting station.

3. A guide as claimed in claim 2 wherein said locking means comprises a spring and said shaft orienting means and said orienting stations comprise mating detents and projections.

* * * * *